US008813652B2

(12) United States Patent
Shin et al.

(10) Patent No.: US 8,813,652 B2
(45) Date of Patent: Aug. 26, 2014

(54) PYROPHORIC PROJECTILE

(75) Inventors: Dae Y. Shin, Tampa, FL (US); Ralph E. Robertson, Jr., Largo, FL (US)

(73) Assignee: Amtec Corporation, Janesville, WI (US)

( * ) Notice: Subject to any disclaimer, the term of this patent is extended or adjusted under 35 U.S.C. 154(b) by 0 days.

(21) Appl. No.: 13/235,146

(22) Filed: Sep. 16, 2011

(65) Prior Publication Data

US 2012/0067242 A1 Mar. 22, 2012

Related U.S. Application Data

(60) Provisional application No. 61/384,222, filed on Sep. 17, 2010.

(51) Int. Cl.

| | |
|---|---|
| ***F42B 8/00*** | (2006.01) |
| ***F42B 12/38*** | (2006.01) |
| ***F42B 12/40*** | (2006.01) |
| ***F42B 12/44*** | (2006.01) |

(52) U.S. Cl.

USPC ..... 102/513; 102/444; 102/498; 102/364; 102/529

(58) Field of Classification Search

USPC ..... 102/364, 365, 395, 444, 445, 447, 498, 102/513, 529

See application file for complete search history.

(56) References Cited

U.S. PATENT DOCUMENTS

| | | | | |
|---|---|---|---|---|
| 734,966 | A * | 7/1903 | Schou | 102/513 |
| 2,071,710 | A | 2/1937 | Schmid | |
| 2,103,698 | A | 12/1937 | Schmid | |
| 2,207,879 | A | 7/1940 | Schmid | |
| 3,289,589 | A * | 12/1966 | Hitchens et al. | 102/513 |
| 3,515,070 | A | 6/1970 | Cutler et al. | |
| 3,712,168 | A | 1/1973 | Mackness et al. | |
| 3,760,729 | A * | 9/1973 | Freeman | 102/346 |
| 3,830,671 | A * | 8/1974 | McArdle | 149/2 |
| 3,861,311 | A * | 1/1975 | Bilsbury | 102/515 |
| 3,970,003 | A | 7/1976 | Hayward et al. | |
| 4,096,804 | A | 6/1978 | Bilsbury | |
| 4,106,411 | A | 8/1978 | Borcher et al. | |
| 4,112,846 | A * | 9/1978 | Gilbert et al. | 102/364 |
| 4,280,408 | A | 7/1981 | Weber et al. | |
| 4,281,599 | A | 8/1981 | Weber et al. | |
| 4,326,463 | A | 4/1982 | Burke et al. | |

(Continued)

FOREIGN PATENT DOCUMENTS

| | | | |
|---|---|---|---|
| WO | WO 2011044126 A2 * | 4/2011 | |
| WO | WO 2012037533 A2 * | 3/2012 | |

OTHER PUBLICATIONS

International Search Report and Written Opinion of the International Searching Authority in International Application No. PCT/US2011/052052, Apr. 26, 2012, 9 pages.

(Continued)

*Primary Examiner* — James Bergin

(74) *Attorney, Agent, or Firm* — Greenberg Traurig, LLP

(57) ABSTRACT

A projectile includes an ogive at a forward end and a projectile body removably coupled to an aft end of the ogive. A signal dye or a filler material is located within a first cavity in the projectile, wherein the first cavity is at least partially located within the ogive. A pyrophoric material is also located within the first cavity, wherein the pyrophoric material is hermetically sealed either within or by the first cavity.

14 Claims, 4 Drawing Sheets

(56) References Cited

U.S. PATENT DOCUMENTS

| | | | | | |
|---|---|---|---|---|---|
| 4,351,239 | A | * | 9/1982 | McCubbin et al. | 102/364 |
| 4,383,485 | A | | 5/1983 | Coates et al. | |
| 4,435,481 | A | | 3/1984 | Baldi | |
| 4,443,557 | A | | 4/1984 | Baldi | |
| 4,444,118 | A | | 4/1984 | Hoffmann et al. | |
| H0000114 | H | * | 8/1986 | Quintavalle | 102/513 |
| 4,649,829 | A | * | 3/1987 | Bilsbury | 102/515 |
| 4,662,280 | A | * | 5/1987 | Becker et al. | 102/364 |
| 4,799,979 | A | | 1/1989 | Baldi | |
| 4,815,386 | A | | 3/1989 | Dillard et al. | |
| 4,970,960 | A | | 11/1990 | Feldmann | |
| 5,020,439 | A | | 6/1991 | Winter et al. | |
| 5,076,169 | A | | 12/1991 | Jeanquartier et al. | |
| 5,121,691 | A | | 6/1992 | Nicolas | |
| 5,341,745 | A | * | 8/1994 | Strandli et al. | 102/499 |
| 5,464,699 | A | | 11/1995 | Baldi | |
| 5,501,751 | A | | 3/1996 | Baldi et al. | |
| 5,631,441 | A | | 5/1997 | Briere et al. | |
| 5,652,408 | A | * | 7/1997 | Nicolas | 102/499 |
| 5,866,840 | A | | 2/1999 | Briere et al. | |
| 5,872,327 | A | * | 2/1999 | Taal et al. | 102/506 |
| 6,055,909 | A | * | 5/2000 | Sweeny | 102/336 |
| 6,305,288 | B1 | | 10/2001 | Nilsson et al. | |
| 7,055,438 | B1 | | 6/2006 | Manole et al. | |
| RE40,482 | E | | 9/2008 | Haeselich | |
| 7,421,950 | B2 | | 9/2008 | Dillard et al. | |
| 7,441,503 | B1 | | 10/2008 | Callaway | |
| 7,475,638 | B2 | | 1/2009 | Haeselich | |
| 7,530,315 | B2 | | 5/2009 | Tepera et al. | |
| 7,819,065 | B2 | | 10/2010 | Haeselich | |
| 7,992,496 | B2 | * | 8/2011 | Dillard et al. | 102/342 |
| 8,424,456 | B2 | * | 4/2013 | Broden et al. | 102/444 |
| 8,438,978 | B2 | * | 5/2013 | Sullivan et al. | 102/513 |
| 8,635,957 | B2 | * | 1/2014 | Orlev et al. | 102/402 |
| 8,640,621 | B2 | * | 2/2014 | Broden et al. | 102/444 |
| 2006/0032393 | A1 | | 2/2006 | Haeselich | |
| 2008/0053330 | A1 | | 3/2008 | Haeselich | |
| 2010/0175577 | A1 | | 7/2010 | Ladyjensky | |
| 2010/0282117 | A1 | | 11/2010 | Cranor et al. | |
| 2010/0307364 | A1 | * | 12/2010 | Orlev et al. | 102/364 |
| 2011/0079164 | A1 | * | 4/2011 | Broden et al. | 102/444 |
| 2011/0308420 | A1 | * | 12/2011 | Mutascio et al. | 102/513 |

OTHER PUBLICATIONS

Quintavalle, Richard M., United States Statutory Invention Registration, Reg. No. H114, Published Aug. 5, 1986.

Broden et al., U.S. Appl. No. 61/278,298, filed Oct. 5, 2009, 53 pages.

Unknown Author, "Pyrophoricity", Internet Wikipedia document downloaded on Jul. 30, 2010 (present Internet address: "http://en.wikipedia.org/wiki/Pyrophoricity"), 2 pages.

Unknown Author, "Synthesis of Pyrophoric Iron," Internet document downloaded from http://backyardchem.com/synthesis-of-pyrophoric-iron.php on Aug. 11, 2010, 2 pages.

International Chemical Supply,"Pyrophoric Iron," Internet document downloaded from http://www.amazingrust.com/ on Aug. 11, 2010, 4 pages.

"Unknown Author,""Synthesizing Pyrophoric Iron (iron thatspontaneously ignites),""Internet document downloaded from http://tutorialtub.com/info/synthesizing-pyrophoric-iron-iron-that-spontaneously-ignites on Aug. 11, 2010, 5 pages."

International Preliminary Report on Patentability of the International Searching Authority in International Application No. PCT/US2011/052052, including PCT Article 34 Amendment and amended sheets of application, Jun. 21, 2013, 23 pages.

* cited by examiner

PYROPHORIC PROJECTILE

CROSS-REFERENCE TO RELATED APPLICATIONS

The instant application claims the benefit of prior U.S. Provisional Application Ser. No. 61/384,222 filed on 17 Sep. 2010, which is incorporated by reference herein in its entirety.

DESCRIPTION OF EMBODIMENT(S)

Figure 1:
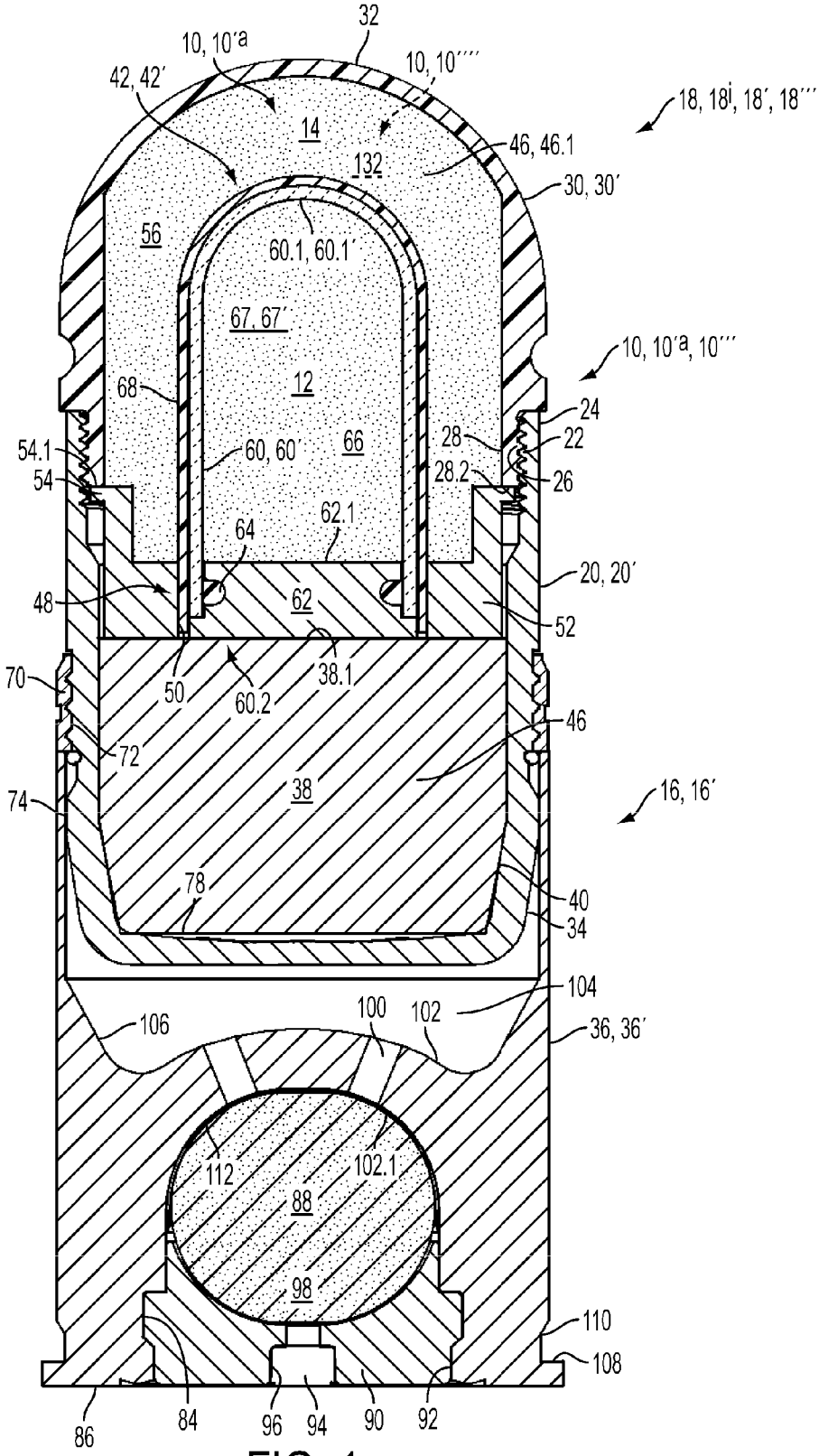
FIG. 1 illustrates a cross-sectional view of a first embodiment of a first aspect of a projectile assembly incorporating a pyrophoric material and a signal dye separated from one another therewithin, wherein the projectile is incorporated in a first aspect of an associated ammunition cartridge assembly.

Referring to FIG. 1, in accordance with a first aspect, a projectile assembly 10, 10' incorporates a pyrophoric material 12 in combination with a signal dye 14 so as to provide for marking a point of impact both temporally with light and heat generated by the pyrophoric material 12 and more lastingly with the signal dye 14, wherein upon impact after being fired from an associated projectile launcher, the signal dye 14 is dispersed from the projectile assembly 10 onto the target and the pyrophoric material 12 is ignited upon exposure to air so as to generate the light and heat. For example, in one embodiment, the projectile assembly 10 is assembled with an associated cartridge-case assembly 16 in an ammunition cartridge assembly 18 so as to provide for launching the projectile assembly 10 from the associated projectile launcher, for example, a gun or a grenade launcher. For example, FIG. 1 illustrates a first aspect of an associated cartridge-case assembly 16, 16' and ammunition cartridge assembly 18, 18' incorporating a first embodiment of the projectile assembly 10, 10'$^{a}$ that is adapted for launching the projectile assembly 10, 10' at a relatively high velocity.

More particularly, the first embodiment of the first aspect of the projectile assembly 10, 10'$^{a}$ comprises a first embodiment of a hollow projectile body 20, 20' having an internal thread 22 in a rim 24 at the forward end thereof within which is threaded a mating external thread 26 on a shouldered cylindrical extension 28 of a first embodiment of a hollow ogive 30, 30' incorporating a hemispherical external surface 32 at a forward end thereof. The base portion 34 of the projectile body 20 is tapered so as to provide for the insertion thereof into a cartridge case 36. For example, FIG. 1 illustrates a first embodiment of a cartridge case 36, 36' of the cartridge-case assembly 16, 16', with a body insert 38 located within an aft portion of the projectile body 20 and shaped so as to conform to the shape of the mating interior portion of the projectile body 20, with a base portion 40 of the body insert 38 tapered similar to the base portion 34 of the projectile body 20.

A sealed capsule 42 containing the pyrophoric material 12 is located within the hollow interior 46 of the ogive 30, 30' and projectile body 20 assembly, forward of a forward surface 38.1 of the body insert 38 and supported thereby. A base 48 of the sealed capsule 42 is located within a central bore 50 of an annular weight 52. The annular weight 52 incorporates a radial flange 54, a forward surface 54.1 of which abuts an aft surface 28.2 of the shouldered cylindrical extension 28 of the ogive 30, 30' so as to provide for substantially sealing a first cavity 56 within an interior 46.1 of the hollow ogive 30, 30', external of the sealed capsule 42, by action of the body insert 38 against the annular weight 52 when the ogive 30, 30' is screwed into the base portion 40. The first cavity 56 is also substantially sealed at the junction of the outside of the sealed capsule 42 with the inside of the central bore 50 of the annular weight 52. The first cavity 56 contains a signal dye 14, for example, in one embodiment comprising a mixture of DAY-GLO® 122-9853 Blazing Orange Pigment, or "Hi Viz" from Lawter Chemical, and fumed silicon dioxide (silica) powder per SAE® AMS 3755 specifications, or per MIL-S-14760 specifications. For example, in one embodiment, the signal dye 14 comprises a mixture of 93 percent DAY-GLO® 122-9853 Blazing Orange Pigment and 7 percent silica by weight, using at least 5 grams of the mixture. For example, the first cavity 56 may be filled with the signal dye 14 either before or after placement of the annular weight 52 over the aft surface 28.2 of the shouldered cylindrical extension 28 of the ogive 30, 30', with the forward end of the ogive 30, 30' pointing down, after which the sealed capsule 42 is inserted through the central bore 50 of the annular weight 52, thereby displacing the signal dye 14 within the first cavity 56. In one embodiment, the first cavity 56 is substantially filled with signal dye 14.

For example, a first embodiment of the sealed capsule 42, 42' comprises a frangible ampoule 60, constructed of a substantially oxygen impermeable material, for example, glass or brittle plastic, having a closed forward end 60.1, for example, a hemi-spherically shaped forward end 60.1', and an open aft end 60.2 that is closed with a plug 62 therein and sealed with an O-ring 64 therebetween. Alternatively, the ampoule 60 could be sealed to the plug 62 by some other means, for example, and adhesive sealant, with our requiring the O-ring 64. The interior of the frangible ampoule 60 bounded by the forward surface 62.1 of the plug 62 defines a substantially hermetically-sealed second cavity 66 of the sealed capsule 42, 42' within the interior 46.1 of the hollow ogive 30, 30', wherein the second cavity 66 contains the pyrophoric material 12 in a substantially oxygen-free environment, for example, with the sealed capsule 42, 42' otherwise filled with an inert gas 67, for example, argon gas 67', so as to substantially prevent a pyrophoric reaction of the pyrophoric material 12 prior to actuation of the projectile assembly 10 upon impact following launch from a projectile launcher at a prospective target. In one embodiment, the frangible ampoule 60 comprises a glass ampoule 60' that is sheathed with a similarly shaped plastic sheath 68 so as to provide for either protecting the glass ampoule 60' from damage if dropped during handling, or so as to provide for substantially containing the pyrophoric material 12 if the glass ampoule 60' should become compromised during handling.

The pyrophoric material 12 is configured so as to become dispersed into the air upon impact of the projectile assembly 10 with an object, thereby causing an auto-initiated pyrophoric combustion of the pyrophoric material 12 in the air. For example, in one embodiment of an ammunition training cartridge, the combusting pyrophoric material 12 is configured to generate a flash of light with a combination of visible, medium wavelength infra-red and long wavelength infra-red frequencies, the intensity of which degrades to about fifty percent of the peak light output within at most five seconds following ignition and with no more than ten percent of peak light output emitted after thirty seconds, wherein the combustion is substantially extinguished before settling from the air, and the pyrophoric material 12 is designed so that an accidental release thereof does not result in an uncontrolled event that could otherwise be hazardous to personnel or materiel. For example, in this embodiment, the pyrophoric material 12 is formed by heating iron (II) oxalate ($FeC_2O_4$), so as to cause the iron (II) oxalate ($FeC_2O_4$) to be decomposed into finely powdered pyrophoric iron metal powder, i.e., the resulting pyrophoric material 12, and carbon dioxide, as follows:

$$FeC_2O_4 \xrightarrow{\Delta} Fe+2CO_2 \quad (1)$$

for example, as described in any of the following internet publications that are incorporated herein by reference in their entirety: "Amazing Rust", http://www.amazingrust.com/Experiments/how_to/Pyrophoric_Fe.html; "Synthesis of Pyrophoric Iron", http://www.backyardchem.com/synthesis-of-pyrophoric-iron.php; and "Synthesizing Pyrophoric Iron (iron that spontaneously ignites)", http://tutorialtub.com/info/synthesizing-pyrophoric-iron-iron-that-spontaneously-ignites. For example, one embodiment of the pyrophoric material 12 was obtained from Esterline Defense Technologies of Coachella, California as a product code-named "Super Hot".

The combustion characteristics of the pyrophoric material 12 would generally depend upon the particular application, and other types of pyrophoric materials 12 could be used. For example, generally powders of iron, aluminum, magnesium, or blends thereof could be used as the pyrophoric material 12, with the particular size or sizes of the associated powder or powders, and the particular blend, if any, adapted to provide for the particular burn rate or total energy level associated with a corresponding particular application.

A rotating band 70 swaged onto circumferential grooves 72 on the outside of the projectile body 20 of the projectile assembly 10 provides for sealing the projectile assembly 10 in an associated launcher tube/barrel used to fire the ammunition cartridge assembly 18, 18', and provides for engaging associated rifling therein so as to provide for rotating the projectile assembly 10 when launched. The rotating band 70 may be adapted to provide for linking separate ammunition cartridge assemblies 18, 18' together, for example, so as to form an associated ammunition belt adapted to provide for continuous automatic loading into an associated launcher.

A portion 74 of the outside of the projectile body 20 between the rotating band 70 and the tapered base portion 34 is adapted to press-fit into the cartridge case 36, 36' of the cartridge-case assembly 16, 16' during assembly thereof, wherein the tapered base portion 34 of the projectile body 20 provides for facilitating assembly of the projectile assembly 10 into the cartridge-case assembly 16, 16', and also facilitating the expulsion therefrom when the ammunition cartridge assembly 18, 18' is fired.

Figure 2:
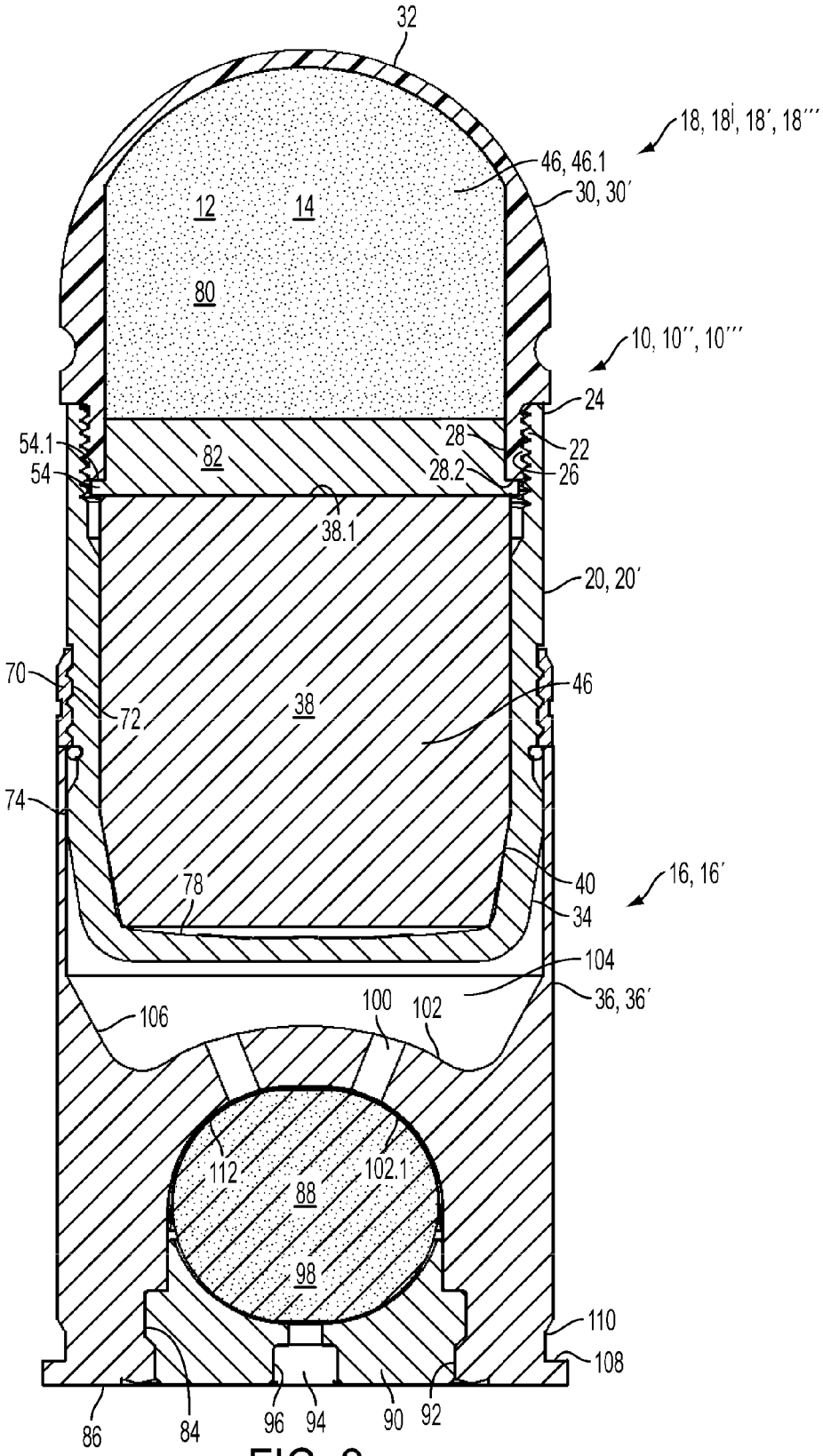
FIG. 2 illustrates a cross-sectional view of a second aspect of a projectile assembly incorporating a pyrophoric material mixed with a signal dye therewithin, wherein the projectile is incorporated in the first aspect of the associated ammunition cartridge assembly.

Referring to FIG. 2, in accordance with a second aspect, a projectile assembly 10, 10" is similar to the first aspect of the projectile assembly 10, 10' in respect of the projectile body 20 and ogive 30, 30', however, the pyrophoric material 12 and signal dye 14 are mixed with one another within a cavity 80 within the interior 46.1 of the hollow ogive 30, 30' that is sealed by a weight plug 82 incorporating a radial flange 54, a forward surface 54.1 of which abuts an aft surface 28.2 of the shouldered cylindrical extension 28 of the ogive 30, 30' so as to provide for substantially sealing the cavity 80 by action of a body insert 38 against the annular weight 52 when the ogive 30, 30' is screwed into the base portion 40, wherein as with the first aspect of the projectile assembly 10, 10', the body insert 38 is located within an aft portion of the projectile body 20 and shaped so as to conform to the shape of the mating interior portion of the projectile body 20, for example, incorporating a tapered base portion 40 so as to conform to the base portion 34 of the projectile body 20. For example, in one embodiment, the cavity 80 contains a mixture containing a minimum of 5 grams of signal dye 14 substantially uniformly mixed with 7 grams of pyrophoric material 12.

Figure 3:
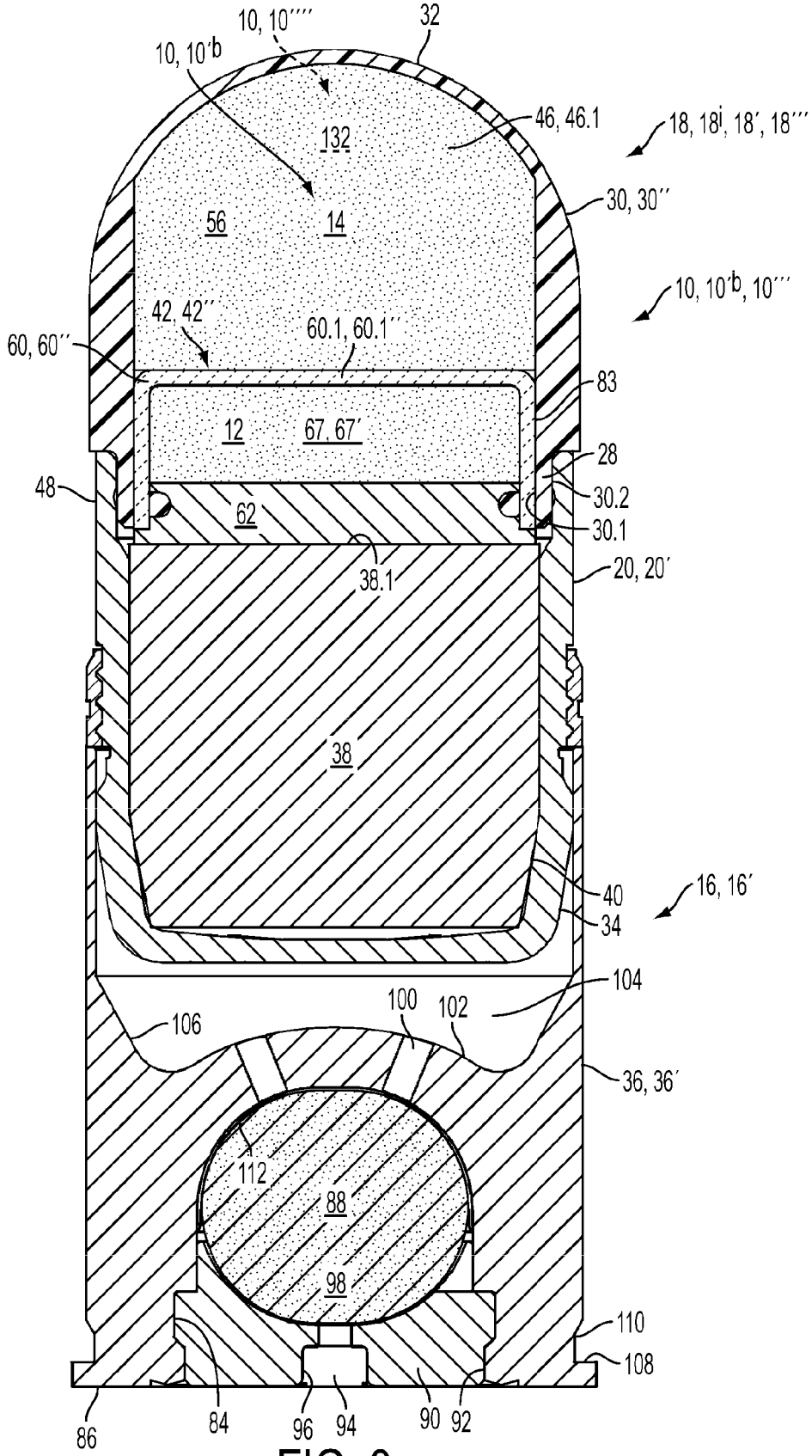
FIG. 3 illustrates a cross-sectional view of a second embodiment of the first aspect of a projectile assembly incorporating a pyrophoric material and a signal dye separated from one another therewithin, wherein the projectile is incorporated in the first aspect of the associated ammunition cartridge assembly.

Referring to FIG. 3, a second embodiment of the first aspect of a projectile assembly 10, 10'$^b$ incorporates a second embodiment of a sealed capsule 42, 42" that is relatively broader and shorter relative to the corresponding relatively narrower and elongated first embodiment of the sealed capsule 42, 42', so as to provide—upon impact—for a relatively different distribution of the associated pyrophoric material 12 into the atmosphere and onto the associated target. For example, the second embodiment of a sealed capsule 42, 42" comprises a frangible ampoule 60, constructed of a substantially oxygen impermeable material, for example, glass or brittle plastic, having a closed forward end 60.1, for example, a relatively flat forward end 60.1", and an open aft end 60.2 that is closed with a plug 62 therein and sealed with an O-ring 64 there between. Alternatively, the ampoule 60 could be sealed to the plug 62 by some other means, for example, and adhesive sealant, with our requiring the 0-ring 64. The interior of the frangible ampoule 60 bounded by the forward surface 62.1 of the plug 62 defines a substantially hermetically-sealed second cavity 66 of the sealed capsule 42, 42" within the interior 46.1 of a second embodiment of a hollow ogive 30, 30", wherein the second cavity 66 contains the pyrophoric material 12 in a substantially oxygen-free environment, for example, with the sealed capsule 42, 42" otherwise filled with an inert gas 67, for example, argon gas 67', so as to substantially prevent a pyrophoric reaction of the pyrophoric material 12 prior to actuation of the projectile assembly 10 upon impact following launch from a projectile launcher at a prospective target. For example, in one embodiment, the frangible ampoule 60 comprises a second embodiment of a glass ampoule 60" that is cylindrically shaped and has an outside diameter 83 that provides for tightly fitting within the inside diameter 30.1 of the hollow ogive 30, 30", and for sealing the first cavity 56 within the interior 46.1 of the hollow ogive 30, 30' containing the associated signal dye 14, with the hollow ogive 30, 30" constructed of plastic so as to provide for sealing against the glass ampoule 60". The second embodiment of a hollow ogive 30, 30" of the second embodiment of the first aspect of a projectile assembly 10, 10'$^b$ is attached to a second embodiment of a hollow projectile body 20, 20" with either or both a press-fit or adhesive bonding between the inside of the rim 24 of the projectile body 20, 20" and an outside diameter 30.2 on a shouldered cylindrical extension 28 of the second embodiment of a hollow ogive 30, 30".

The base 48 of the sealed capsule 42, 42" and the associated plug 62 are supported by the forward surface 38.1 of the associated body insert 38, without necessarily requiring a separate annular weight 52 or weight plug 82 as used in the first embodiment of the first aspect of the projectile assembly 10, 10'[a] or the illustrated embodiment of the second aspect of the projectile assembly 10, 10", although a separate relatively denser annular weight 52 or weight plug 82 could be used if the weight of the body insert 38 were insufficient.

Otherwise, the second embodiment of the first aspect of a projectile assembly 10, 10' is substantially the same as the first embodiment described hereinabove.

It should be understood that the shape of the sealed capsule 42 is not limiting. For example, alternatively, the sealed capsule 42 could have an elongated cylindrical shape, a cylindrical shape of arbitrary aspect ratio, a conical shape, a frustroconical shape, a hemispherical shape, a frustro-hemispherical shape, a generally convex shape or an at least partially concave shape.

Referring to FIGS. 1-3, in an example of one set of embodiments for application to a particular type of cartridge-case assembly 16, 16', the projectile assembly 10, 10', 10" is fitted to, for example, press-fitted into, a cartridge case 36, 36' of an associated cartridge-case assembly 16, 16'. For example, in one embodiment, the cartridge case 36, 36' is a metallic hollow cylindrical structure, for example, of aluminum or brass, incorporating an open well 84 in a base 86 thereof, which contains an associated propellant charge 88 therein, and which is sealed with a metal base plug 90 crimped to the edge 92 of the open well 84. A percussion primer 94 is crimped into a central opening 96 in the base plug 90, and is in communication with a first chamber 98 bounded by the open well 84 and the base plug 90. The first chamber 98 is vented through vent holes 100 in an internal partition 102 within the cartridge case 36, 36', a first surface 102.1 of which defines the open well 84 and partially bounds the first chamber 98. The vent holes 100 provide for fluid communication with a second chamber 104, which is separated from the first chamber 98 by the internal partition 102, and which is further bounded by the interior surface 106 of the cartridge case 36, 36', and by the projectile assembly 10 assembled therewith. The base 86, of the cartridge case 36, 36', incorporates a flanged cylindrical rim 108 and a circumferential extractor groove 110 adjacent thereto that provide for chambering and removal of the ammunition cartridge assembly 18, 18' in and from an associated gun that provides for the use thereof. The propellant charge 88 is contained within a closing cup 112, for example, of copper, within the open well 84/ first chamber 98, which provides for environmentally sealing the first chamber 98, and which is ruptured at the vent holes 100 upon activation of the propellant charge 88 so as to provide for the propellant gases generated therefrom to escape from the first chamber 98 through the vent holes 100, and into the second chamber 104, thereby providing for pressurizing the second chamber 104 so as to provide for launching the projectile assembly 10 from the ammunition cartridge assembly 18, 18'.

However, it should be understood that the particular cartridge-case assembly 16, 16' described hereinabove is not limiting, and that the projectile assembly 10 can generally be used with any type of cartridge-case assembly 16 of any size or design, provided that the cartridge-case assembly 16 is adapted to launch the projectile assembly 10. For example, generally a cartridge-case assembly 16 would include a cartridge case 36—that provides for mating to a base portion 34 of the projectile body 20 of the projectile assembly 10—a propellant charge 88, and an associated primer, for example either a percussion primer 94, and electric primer or a laser-initiated primer, so as to provide for ejecting the projectile assembly 10 from the cartridge-case assembly 16 upon initiation of the primer.

Figure 4:
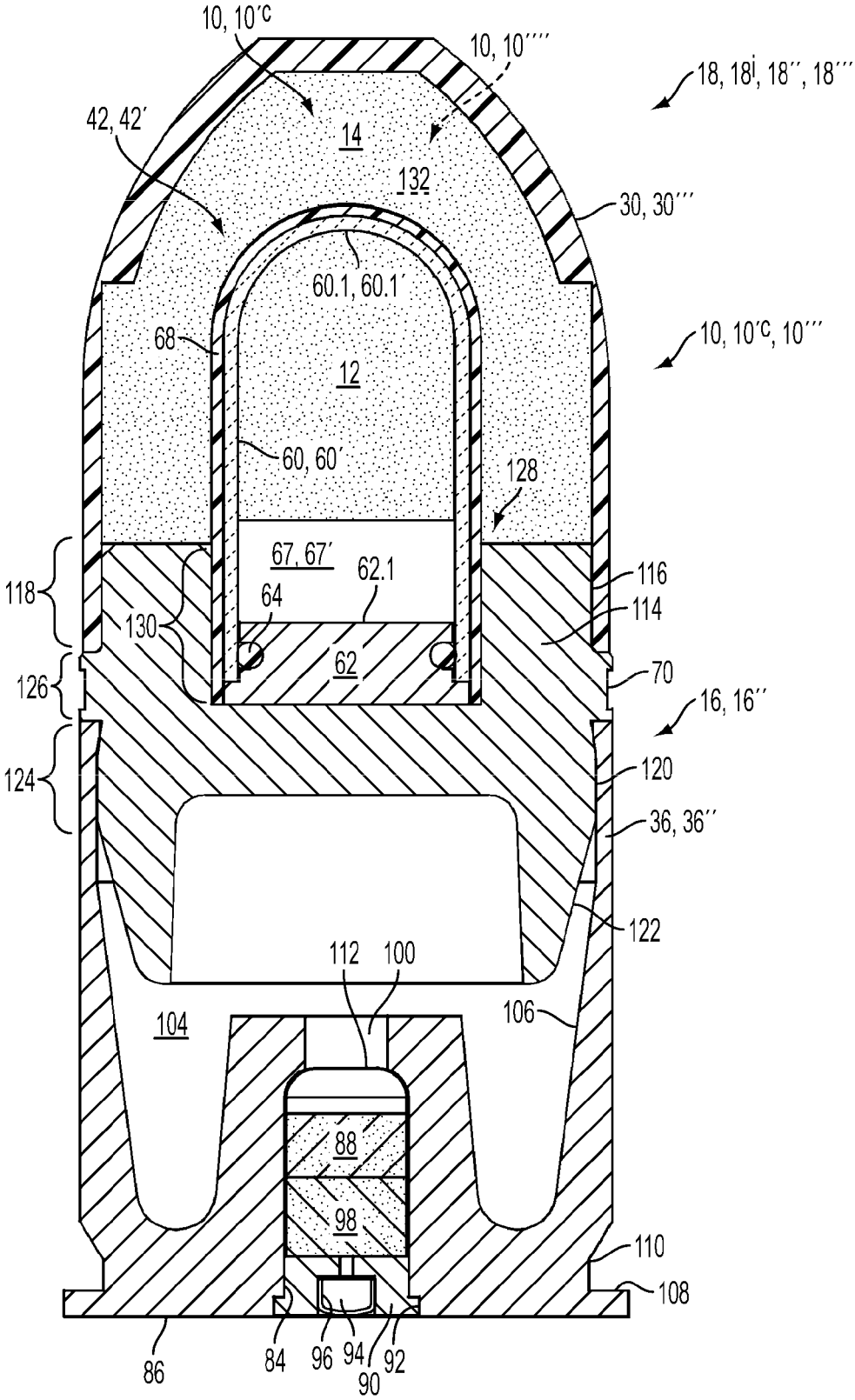
FIG. 4 illustrates a cross-sectional view of a third embodiment of the first aspect of a projectile assembly incorporating a pyrophoric material and a signal dye separated from one another therewithin, wherein the projectile is incorporated in a second aspect of an associated ammunition cartridge assembly.

Referring to FIG. 4, a third embodiment of the first aspect of a projectile assembly 10, 10'[c] comprises a projectile body 114 having a forward shouldered surface 116 upon which is either or both press-fit or adhesively bonded within an aft end portion 118 of a third embodiment of a hollow ogive 30, 30'", and an aft shouldered surface 120 and abutting tapered base portion 122 that provides for insertion into and coupling to a forward end portion 124 of a second embodiment of a cartridge case 36, 36". An middle portion 126 of the projectile body 114 intermediate to the forward 116 and aft 120 shouldered surfaces forms the rotating band 70 of the projectile assembly 10, 10'[c]. For example, in one embodiment, the projectile body 114 is constructed of die-cast zinc.

The third embodiment of the first aspect of a projectile assembly 10, 10'[c] incorporates the first embodiment of sealed capsule 42, 42' as described hereinabove, but with the base 48 thereof inserted within a blind hole 128 in the forward end portion 130 of the projectile body 114 so as to provide for locating the remaining portion of the sealed capsule 42, 42' within the interior 46.1 of the hollow ogive 30, 30'". A first cavity 56 surrounding the remaining portion of the sealed capsule 42, 42' within the interior 46.1 of the hollow ogive 30, 30'" contains a signal dye 14 formulated as described hereinabove, wherein the first cavity 56 is sealed at the junction between the forward shouldered surface 116 of the projectile body 114 and the inside of the aft end portion 118 of the hollow ogive 30, 30'". The sealed capsule 42, 42' contains a pyrophoric material 12 and an inert gas 27 in a hermetically-sealed frangible ampoule 60, constructed of a substantially oxygen impermeable material, for example, glass or brittle plastic, having a closed forward end 60.1, and an open aft end 60.2 that is closed with a plug 62 therein and sealed with an O-ring 64 therebetween, and sheathed with a similarly shaped plastic sheath 68, as described hereinabove. Alternatively, the ampoule 60 could be sealed to the plug 62 by some other means, for example, and adhesive sealant, with our requiring the O-ring 64.

For example, the third embodiment of the first aspect of a projectile assembly 10, 10'[c] illustrated in FIG. 4 is incorporated in a corresponding second aspect of a ammunition cartridge assembly 18, 18" comprising a corresponding second aspect of a cartridge-case assembly 16, 16" that provides launching the associated third embodiment of the first aspect of a projectile assembly 10, 10'[c] at a relatively lower velocity.

More particularly, the projectile assembly 10, 10'[c] is fitted to, for example, press-fitted into, a cartridge case 36, 36" of an associated cartridge-case assembly 16, 16" For example, in one embodiment, the cartridge case 36, 36" is a metallic hollow cylindrical structure, for example, of aluminum or brass, incorporating an open well 84 in a base 86 thereof, which contains an associated propellant charge 88 therein, and which is sealed with a metal base plug 90 crimped to the edge 92 of the open well 84. A percussion primer 94 is crimped into a central opening 96 in the base plug 90, and is in communication with a first chamber 98 bounded by the open well 84 and the base plug 90. The first chamber 98 is vented through a vent hole 100 in an internal partition 102 within the cartridge case 36, 36", a first surface 102.1 of which defines the open well 84 and partially bounds the first chamber 98. The vent hole 100 provides for fluid communication with a second chamber 104, which is separated from the first chamber 98 by the internal partition 102, and which is further bounded by the interior surface 106 of the cartridge case 36, 36", and by the projectile assembly 10, 10'[c] assembled therewith. The base 86, of the cartridge case 36, 36", incorporates a flanged cylindrical rim 108 and a circumferential extractor groove 110 adjacent thereto that provide for chambering and removal of the ammunition cartridge assembly 18, 18" in and from an associated gun that provides for the use thereof. The propellant charge 88 is contained within a closing cup 112, for example, of copper, within the open well 84/ first chamber 98, which provides for environmentally sealing the first chamber 98, and which is ruptured at the vent hole 100 upon activation of the propellant charge 88 so as to provide for the propellant gases generated therefrom to escape from the first chamber 98 through the vent holes 100, and into the second chamber 104, thereby providing for pressurizing the second chamber 104 so as to provide for launching the projectile assembly 10 from the ammunition cartridge assembly 18, 18".

In operation, the ammunition cartridge assembly 18, 18', 18" is loaded into associated launcher having a firing mechanism that when activated, actuates a firing pin that activates the percussion primer 94, which then activates the propellant charge 88 in the first chamber 98, which generates hot gases therein. When the pressure in the first chamber 98 is sufficiently high, the closing cup 112 ruptures at locates proximate to the vent holes 100 in the internal partition 102, allowing the relatively high-pressure hot gases from the first chamber 98 to discharge therethrough into the second chamber 104, and act against the base 78 and base portion 34 of the of the projectile body 20, which causes the projectile assembly 10 to be launched from the cartridge-case assembly 16, 16', 16" of the ammunition cartridge assembly 18, 18', 18" and accelerated within the launcher tube/barrel.

In accordance with one set of embodiments, the projectile assembly 10, 10', 10" is used in a day/night ammunition training cartridge 18$^{i}$, so as to provide for generating a flash of light and heat to indicate the impact location at the time of impact, which can be useful under any conditions, but which is particularly useful during nighttime training exercises; and so as to provide for marking the impact location with the signal dye 14 so as to provide for more lasting evidence thereof, for example, so as to provide for inspection and evaluation thereof either immediately, for example, during daylight conditions, or at a later time, for example, after a training exercise has been completed, for example, during daylight conditions following a nighttime training exercise.

In one set of embodiments, the day/night ammunition training cartridge 18$^{i}$ is constructed with a plastic ogive 30, 30', 30", 30", e.g. of Delrin®, polystyrene or polypropylene, that mates with a steel projectile body 20 containing an aluminum body insert 38 that supports a steel or stainless steel annular weight 52 or weight plug 82 depending upon the aspect of the projectile assembly 10, 10', 10", and for the first aspect of the projectile assembly 10, 10', the sealed capsule 42 comprises a glass ampoule 60' closed with an aluminum plug 62 sealed with a 70 Durometer Buna-N O-ring 64, and sheathed with a plastic sheath 68, e.g. of acrylic, polystyrene or polypropylene. For example, the plastic sheath 68 may be either separately molded prior to assembly with the glass ampoule 60, or molded therearound. The size of the annular weight 52 or weight plug 82 and body insert 38 are adapted in cooperation with the remaining elements of the day/night ammunition training cartridge 18$^{i}$ so as to substantially match the weight and the location of the center-of-gravity of the corresponding live ammunition so as to substantially match the ballistic characteristics thereof. The day/night ammunition training cartridge 18$^{i}$ may be constructed of various sizes and adapted for a variety of launchers. For example, in one embodiment, the ammunition cartridge assembly 18, 18' is used in a MK-19 40 mm grenade launcher in place of 40 mm grenade assemblies, for example, incorporating a M169 cartridge case 36, 36', with either high- or low-velocity projectiles.

In operation, upon impact of the projectile assembly 10, 10', 10" with an object, the ogive 30, 30' ruptures, as does the sealed capsule 42 in the first aspect of the projectile assembly 10, 10', thereby dispersing the signal dye 14 and pyrophoric material 12 into the air and onto the object at and proximate to the point of impact, wherein the pyrophoric material 12 is auto-ignited by contact with the air and combusted therewith so as to briefly generate light and heat that provides for marking the point of impact in a manner that is visible at night, and the signal dye 14 provides for more lastingly marking the point of impact.

In accordance with another set of embodiments, the projectile assembly 10, 10', 10" can be adapted as an incendiary projectile 10'''—for example, of an associated incendiary cartridge assembly 18'''—for purposes of remotely setting back fires as necessary to control wildfires, wherein, for example, the signal dye 14 provides for marking the point of impact for purposes of either targeting or post-incident investigation, and the pyrophoric material 12 is adapted to generate a sufficient amount of heat so as to provide for igniting the combustible material in the target area, for example, using the same pyrophoric iron as described hereinabove, but with a slower burn rate and/or a longer burn time, and also possibly with the addition of other accelerants such as aluminum to the signal dye 14 so as to provide for a more energetic combustion.

In accordance with a third aspect of a projectile assembly 10, 10'''', all or a portion of the signal dye 14 is replaced with a filler material 132, for example, comprising either an inert powder, granular or solid material that provides for a payload ballast mass and provides for protecting, e.g. cushioning, the frangible ampoule 60, 60', 60" from damage, for example, as a result of mechanical shock, impact or vibration, for example associated with the handing of the projectile assembly 10, 10'''' either alone or as assembled in an ammunition cartridge assembly 18. For example, in one set of embodiments, all of the signal dye 14 is replaced with the filler material 132 so that the associated projectile assembly 10, 10'''' does not necessarily provide for marking a point of impact with a signal dye 14 as described herein above in respect of the first and second aspects of the projectile assembly 10, 10', 10'$^{a}$, 10'$^{b}$, 10'$^{c}$, 10". For example, the third aspect of the projectile assembly 10, 10'''' could be alternatively embodied in any of the embodiments illustrated in FIGS. 1, 3 and 4, which otherwise are configured and operate as described hereinabove.

Generally, it should be understood that other materials that do not otherwise prevent a pyrophoric action of the pyrophoric material 12 may be mixed therewith, for example, so as to provide for proper overall mass and aeroballistic properties of the projectile assembly 10, 10', 10'$^{a}$, 10'$^{b}$, 10'$^{c}$, 10", 10''', 10''''. Similarly, the particular type and amount of signal dye 14 or filler material 132, and the relative amounts thereof if together mixed, is selected or adapted so as to provide or proper overall mass and aeroballistic properties of the projectile assembly 10, 10', 10'$^{a}$, 10'$^{b}$, 10'$^{c}$, 10", 10''', 10'''' and if used in combination with a frangible ampoule 60, 60', 60", so as to provide for protecting the frangible ampoule 60, 60', 60" from damage, for example, as a result of mechanical shock, impact or vibration, for example associated with the handing of the projectile assembly 10, 10', 10'$^{a}$, 10'$^{b}$, 10'$^{c}$, 10''', 10''', 10'''' either alone or as assembled in an ammunition cartridge assembly 18. For example, the mass properties of the projectile assembly 10, 10', 10'$^{a}$, 10'$^{b}$, 10'$^{c}$, 10", 10''', 10'''' include the overall weight, the associated polar moments of inertia and the location of the associated center-of-gravity (CG); and the aeroballistic properties further include obturation for in-bore ballistics and precession and nutation damping for exterior ballistics.

It should be understood that the cross-sectional views illustrated in FIGS. 1-4 are each associated with an associated cutting plane through a corresponding central longitudinal axis of the associated projectile assembly 10, and except for the internal 22 and external 26 threads illustrated in FIGS. 1 and 2, and except for the vent holes 100 illustrated in FIGS. 1-3, the lines in each of FIGS. 1-4 illustrate cross-sections through associated surfaces of revolution about the central longitudinal axis of the associated projectile assembly 10.

While specific embodiments have been described in detail in the foregoing detailed description and illustrated in the accompanying drawings, those with ordinary skill in the art will appreciate that various modifications and alternatives to those details could be developed in light of the overall teachings of the disclosure. It should be understood, that any reference herein to the term "or" is intended to mean an "inclusive or" or what is also known as a "logical OR", wherein when used as a logic statement, the expression "A or B" is true if either A or B is true, or if both A and B are true, and when used as a list of elements, the expression "A, B or C" is intended to include all combinations of the elements recited in the expression, for example, any of the elements selected from the group consisting of A, B, C, (A, B), (A, C), (B, C), and (A, B, C); and so on if additional elements are listed. Furthermore, it should also be understood that the indefinite articles "a" or "an", and the corresponding associated definite articles "the" or "said", are each intended to mean one or more unless otherwise stated, implied, or physically impossible. Yet further, it should be understood that the expressions "at least one of A and B, etc.", "at least one of A or B, etc.", "selected from A and B, etc." and "selected from A or B, etc." are each intended to mean either any recited element individually or any combination of two or more elements, for example, any of the elements from the group consisting of "A", "B", and "A AND B together", etc. Yet further, it should be understood that the expressions "one of A and B, etc." and "one of A or B, etc." are each intended to mean any of the recited elements individually alone, for example, either A alone or B alone, etc., but not A AND B together. Furthermore, it should also be understood that unless indicated otherwise or unless physically impossible, that the above-described embodiments and aspects can be used in combination with one another and are not mutually exclusive. Accordingly, the particular arrangements disclosed are meant to be illustrative only and not limiting as to the scope of the invention, which is to be given the full breadth of the appended claims, and any and all equivalents thereof.

What is claimed is:

1. A projectile, comprising:

a. an ogive at a forward end of the projectile;

b. a projectile body removably coupled to an aft end of said ogive;

c. a signal dye or a filler material within a first cavity in said projectile, wherein said first cavity is at least partially located within said ogive;

d. a frangible ampoule sheathed in a plastic sheath in said first cavity and coupled to the projectile body, the ampoule containing a pyrophoric material within said ampoule, wherein said pyrophoric material is hermetically sealed within said ampoule; and e. an inert gas within said ampoule preventing oxygen from contact with said pyrophoric material.

2. A projectile as recited in claim 1, further comprising a ballistic weight either within or constituted by said projectile body, wherein at least a portion of said ballistic weight is located aft of said aft end of said ogive.

3. A projectile as recited in claim 2, wherein said projectile is for use in an ammunition training cartridge, and a weight of said ballistic weight in combination with a weight of a remaining portion of said projectile is configured so that a total weight of said projectile and a location of a center of gravity of said projectile substantially matches that of a corresponding projectile in a live ammunition cartridge to which said ammunition training cartridge corresponds.

4. A projectile as recited in claim 1, wherein said sheathed ampoule is located entirely within said ogive.

5. A projectile as recited in claim 1, wherein at least a portion of said signal dye or said filler material is located in an annular region between an outside of said frangible ampoule and an inside of said ogive.

6. A projectile as recited in claim 1, further comprising:

a. the ampoule is a frangible glass ampoule located within said first cavity; and b. an ampoule closure at an opening of said frangible ampoule, wherein said ampoule closure provides for sealing said opening of said frangible ampoule and for defining a second cavity within said frangible ampoule, said pyrophoric material and said inert gas are located within said second cavity, and said second cavity is hermetically sealed by said ampoule closure so as to provide for hermetically sealing said pyrophoric material within said first cavity.

7. A projectile as recited in claim 6, wherein an outside cylindrical surface of said frangible ampoule mates with and is sealed to an inside cylindrical surface of said ogive.

8. A projectile as recited in claim 7, wherein a substantial portion of a forward end of said frangible ampoule comprises a relatively flat surface.

9. A projectile as recited in claim 6, wherein said first cavity comprises a solid material that provides for cushioning said frangible ampoule.

10. A projectile as recited in claim 1, wherein said pyrophoric material comprises at least one metallic powder of at least one material selected from the group consisting of iron, aluminum and magnesium.

11. A projectile as recited in claim 1, wherein said projectile is assembled to a cartridge-case sub-assembly so as to form an ammunition training cartridge assembly.

12. A projectile as recited in claim 1, wherein said projectile is configured as an incendiary projectile and is assembled to a cartridge-case sub-assembly so as to form an incendiary cartridge assembly.

13. A projectile as recited in claim 1, wherein said filler material comprises an inert powder or granular material.

14. A projectile as recited in claim 1, wherein said filler material provides a ballast mass within said projectile.

* * * * *

UNITED STATES PATENT AND TRADEMARK OFFICE

CERTIFICATE OF CORRECTION

PATENT NO. : 8,813,652 B2
APPLICATION NO. : 13/235146
DATED : August 26, 2014
INVENTOR(S) : Shin et al.

It is certified that error appears in the above-identified patent and that said Letters Patent is hereby corrected as shown below:

In the Specification

In Column 4, Line 35, delete “0-ring” and insert -- O-ring --, therefor.

In Column 7, Line 46, delete “30', 30", 30",” and insert -- 30', 30", 30'", --, therefor.

Signed and Sealed this
Second Day of June, 2015

Michelle K. Lee

Michelle K. Lee
*Director of the United States Patent and Trademark Office*